United States Patent [19]

Reed

[11] Patent Number: 4,986,207

[45] Date of Patent: Jan. 22, 1991

[54] BOAT HOOK DEVICE

[75] Inventor: Allan R. Reed, St. Clair Shores, Mich.

[73] Assignee: Reed Nauticals, Inc., St. Clair Shores, Mich.

[21] Appl. No.: 502,301

[22] Filed: Mar. 30, 1990

[51] Int. Cl.[5] ..... B63B 9/00

[52] U.S. Cl. ..... 114/221 R; 114/230; 294/19.1

[58] Field of Search ..... 114/221 R, 230; 294/19.1, 82.27, 82.24, 82.35; 24/489, 499, 500, 509, 238, 239, 241 S, 241 SL

[56] References Cited

U.S. PATENT DOCUMENTS

| | | | |
|---|---|---|---|
| 1,468,884 | 9/1923 | Schneider | 24/500 |
| 2,979,013 | 4/1961 | Whittall | 114/221 R X |
| 3,733,097 | 5/1973 | Hank, Jr. | 294/19 R |
| 3,913,515 | 10/1975 | Hernsjo et al. | 114/230 |
| 3,993,013 | 11/1976 | Nunziato et al. | 114/221 R |
| 4,793,646 | 12/1988 | Michaud, Jr. | 114/221 R X |
| 4,932,700 | 6/1990 | Hart | 114/221 R X |

OTHER PUBLICATIONS

Hook-Stick Product literature of T & L Products, approx. 1990.

*Primary Examiner*—Ed Swinehart
*Attorney, Agent, or Firm*—Peter D. Keefe

[57] ABSTRACT

A boat hook which permits selectively releasable connection with respect to a conventional snap-hook of a standard mooring line. The boat hook is composed of a handle which terminates at a remote end in a snap-hook holder. The snap-hook holder is composed of two parts: (1) a seating member which is dimensioned so that the general vicinity of the eyelet area of a conventional snap-hook can seat snugly therein, and (2) a biasing member, which is hingably biased with respect to the seating member so as to selectively retain the snap-hook seated in the seating member. Once the snap-hook has been manipulated by the handle so as to be connected onto an eyelet of an object, such as the bow eyelet of a boat, a sharp pull on the handle will cause the snap-hook to be released from the handle of the boat hook.

10 Claims, 5 Drawing Sheets

BOAT HOOK DEVICE

BACKGROUND OF THE INVENTION

1. Field of the Invention

The present invention relates to boat hook devices used for attaching to eyelets of the type commonly used for mooring boats, and more particularly to an improved boat hook device which permits the user to make selective connection with respect to a winch line snap-hook which in turn connects selectably with the boat bow eyelet.

2. Description of the Prior Art

Pleasure watercraft (hereinafter referred to simply as "boats") generally utilize an eyelet located at the bow for the purpose of providing a releasable connection to a winch line. The winch line is provided at its remote end with a snap-hook which is structured to engage the bow eyelet in a selectively releasable manner. The other end of the winch line emanates from a winch on a boat trailer. The winch line is used to winch the boat onto the boat trailer by pulling the boat at the bow eyelet. This method of mounting the boat onto the boat trailer is used because straightforward alignment of the boat on the boat trailer is facilitated.

A problem is encountered when the boat is about to be mounted back onto the boat trailer. The problem is that the connection of the winch line snap-hook to the boat bow eyelet is next to impossible to accomplish when the boat is distant from the boat trailer. Practically every boat owner can recall instances when he got wet trying to connect the winch line to the boat when he was attempting to place his boat on the boat trailer.

In the prior art there have been attempts to solve this problem. For instance, U.S. Pat. No. 3,733,097 to Hank, Jr., dated May 15, 1973, discloses a boat hook having a handle to which is releasably connected a special hook device at its end. The special hook device is connected to the end of the winch line, and once the special hook device is mounted onto the bow eyelet, a twist of the boat hook handle releases the special hook device from the boat hook. Unfortunately, the special hook of Hank, Jr. has no provision for retaining the hook onto the boat eyelet once connection is made, as is provided for in conventional winch line hooks by operation of a spring-loaded snap. Further, the winch line must be connected to this special hook device, so that conventional winch lines having conventional snap-hooks cannot be used. Another instance is U.S. Pat. No. 3,913,515 to Hernsjo et al, dated Oct. 21, 1975, which discloses a boat hook that has a handle ending in a cavity for releasably receiving a special snap-hook. The special snap-hook is foldable back on itself, and when folded is able to nest in the cavity. The reason for requiring that the special snap-hook of Hernsjo et al be foldable is to ensure that the winch line, which is connected to the special snap-hook, will not interfere with insertion of the special snap-hook into the cavity. Again, the problem is that a special type of snap-hook must be used, thereby forcing users to purchase an expensive specialized snap-hook which cannot be used with a conventional winch line equipped with a conventional snap-hook.

Accordingly, what is needed is a boat hook having structural provision for releasably holding the conventional snap-hook of a standard winch line.

SUMMARY OF THE INVENTION

The present invention is a boat hook which permits releasable connection with respect to a conventional snap-hook of a standard winch line.

The present invention is composed of a handle which terminates at one end in a snap-hook holder for a conventional winch line snap-hook. The snap-hook holder is composed of two parts: a seating member which is dimensioned so that the general vicinity of the eyelet area of a conventional snap-hook can seat snugly therein, and a biasing member, which is hingably biased with respect to the seating member so as to selectively retain the snap-hook seated in the seating member. Once the snap-hook has been manipulated by the handle so as to be connected onto the bow eyelet of the boat, a sharp pull on the handle will cause the snap-hook to be released from the handle of the boat hook.

Accordingly, it is an object of the present invention to provide a boat hook having a handle for manipulating a boat, the boat hook further having a snap-hook holder for selectively releasably holding a conventional snap-hook of a standard winch line.

It is an additional object of the present invention to provide a boat hook in which a conventional snap-hook is releasably connected thereto, the conventional snap-hook being releasable from the boat hook simply by applying a sharp pull to the boat hook after the conventional snap-hook has been secured to an eyelet of an object, such as the bow of a boat.

It is yet a further object of the present invention to provide a boat hook having provision for selectively releasably holding a conventional snap-hook, in which the boat hook may be further used for guiding the boat as needed, such as off or on the boat trailer, or toward or away from a dock.

It is still a further object of the present invention to provide a boat hook having provision for releasably holding a conventional snap-hook, as well as releasably holding other items, such as a winch or mooring line. In this manner, the boat hook may be used, for instance, to manipulate a mooring line onto a dock cleat, then be released therefrom once this connection has been made.

It is still a further object of the present invention to provide a boat hook having provision for selectively releasably holding a conventional snap-hook, in which the handle portion of the boat hook is telescoping.

These, and additional objects, advantages, features and benefits of the present invention will become apparent from the following specification.

DETAILED DESCRIPTION OF THE PREFERRED EMBODIMENT

Figure 1:
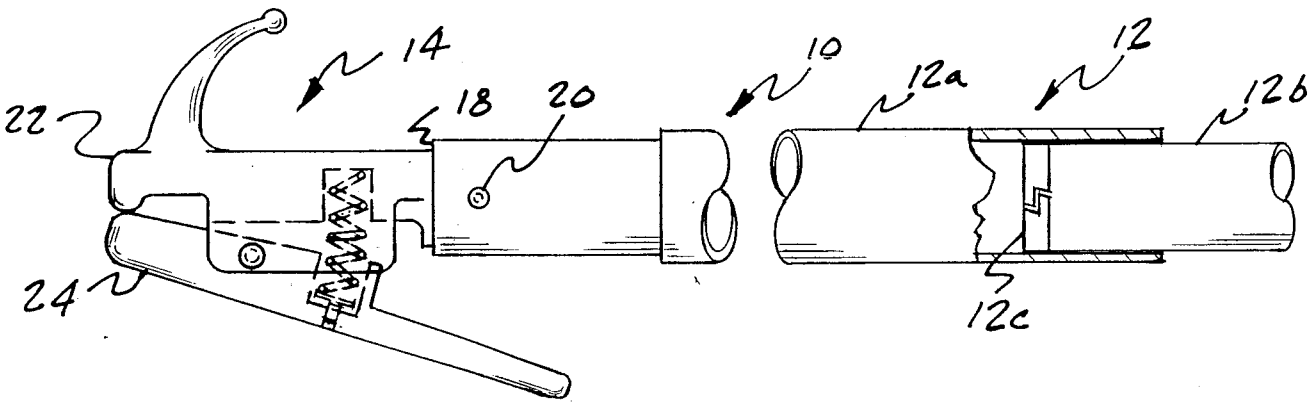
FIG. 1 is a part sectional side view of the boat hook according to the present invention.

Referring now the the Drawing, FIG. 1 generally shows the construction of the boat hook 10 according to the present invention. The boat hook 10 is composed of two basic parts: a handle 12 and a snap-hook holder 14 which is connected to one end of the handle.

The handle 12 is preferred to be shaped as an elongate cylinder of about four feet in length and about one inch in diameter. It is further preferred that the handle 12 constructed of a structurally strong, non-corrosive material, such as either plastic or aluminum. It is still further preferred for the handle 12 to have a telescopic construction, in which one section 12*a* telescopicaly receives another section 12*b*, and so on for a multiplicity of such sections. Each of the sections is releasably retained at a selected location by any conventional mechansim familiar to the art of telescoping handles, such as an offset member 12*c* connected to an end of a received section 12*b* that can be frictionally forced against the receiving section 12*a* when the received section 12*b* is relatively rotated.

The snap-hook holder 14 is provided with a reduced diameter shank 16 (see FIG. 2) which is structured to snugly fit into the remote end 18 of the handle 12, and is secured thereto by a rivet 20. The snap-hook holder 14 is composed of a seating member 22 which is structured to receive a conventional snap-hook in the vicinity of the eyelet area of the snap hook (the specifics of which shall be elaborated hereinbelow), and of a biasing member 24 which is pivotably connected with respect to the seating member for releasbly biasing the snap-hook into a seated position on the seating member 22.

Figure 2:
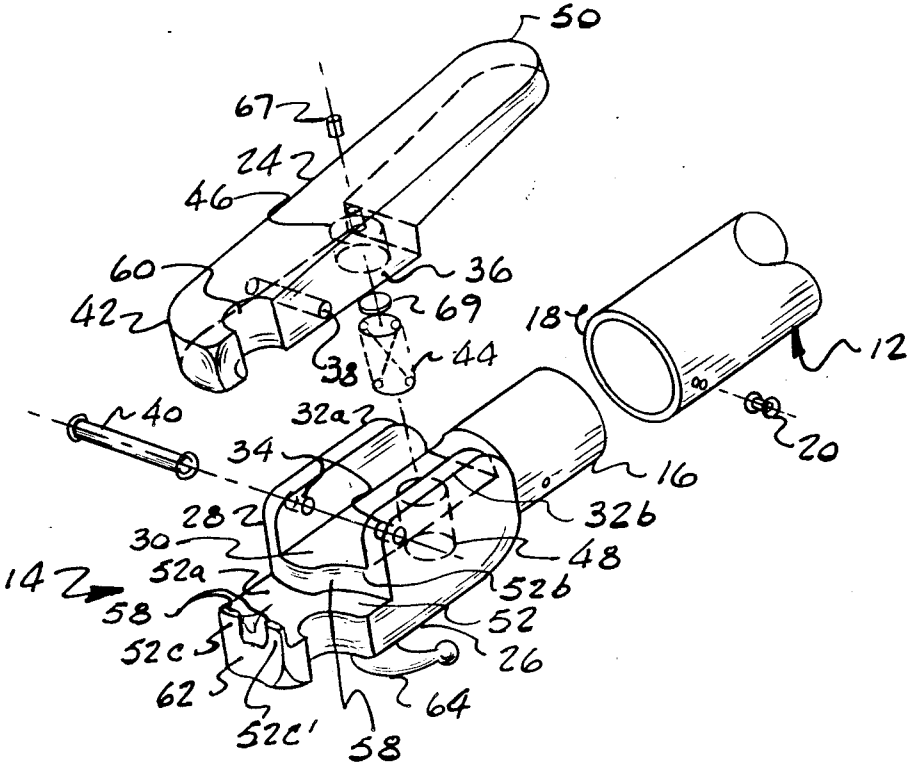
FIG. 2 is a perspective view of the boat hook according to the present invention, detailing an exploded view of the snap-hook holder.
Figure 3:
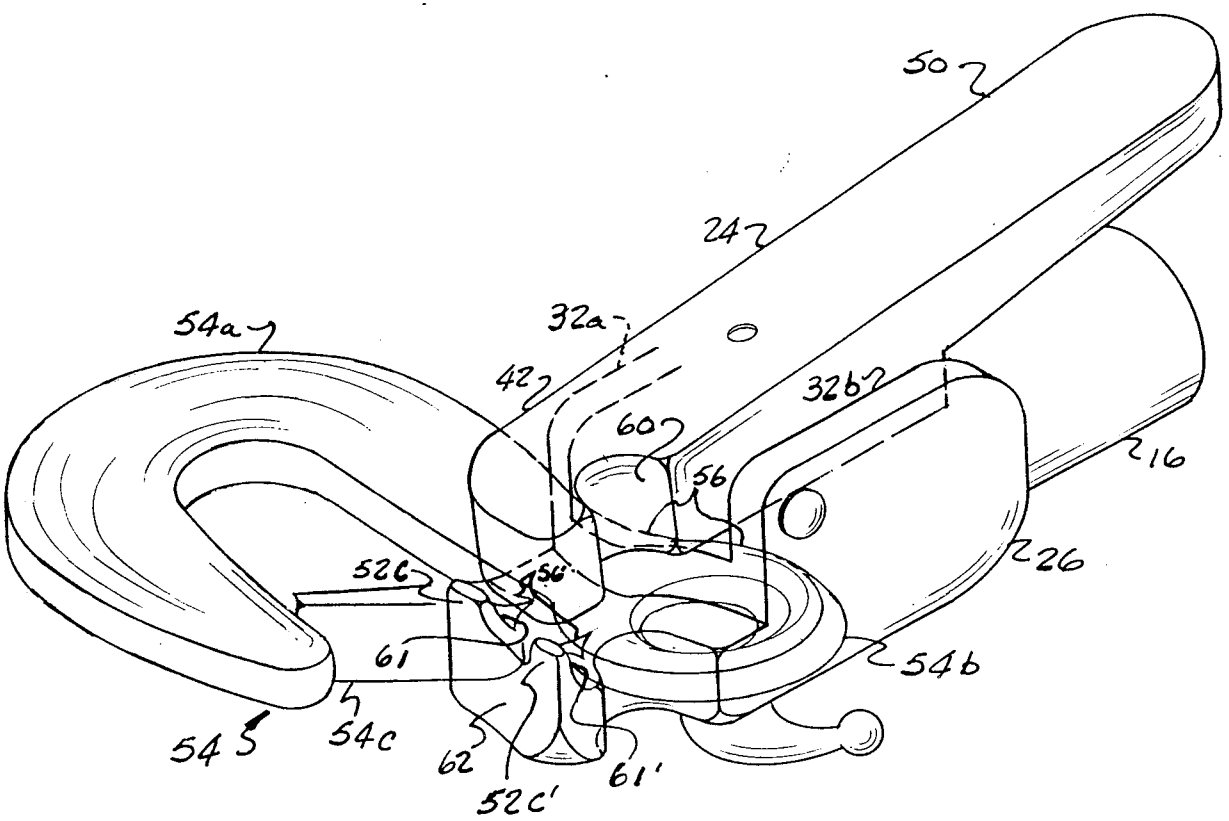
FIG. 3 is a detail perspective view of the snap-hook holder of the present invention, showing the present invention in operation with a conventional snap-hook mounted therein.

Now referring to FIGS. 2 and 3, the structural details of the snap-hook holder 14 will be detailed.

The seating member 22 includes a main body 26 which is integrally connected with the shank 16. On one side of the main body 26 is a U-shaped member 28. The U-shaped member 28 is defined by a floor 30 and on either side thereof two spaced apart upstanding flanges 32*a* and 32*b*. Each flange 32*a* and 32*b* contains an aperture 34. Into the U-shaped member 28 fits a central section 36 of the the biasing member 24. The central section 36 has an aperture 38 which is aligned with the apertures 34 on the flanges 32*a* and 32*b*. A pin 40 is inserted through the apertures 34 and 38, thereby providing a pivot connection between the biasing member 24 and the seating member 22. The forward end 42 of the biasing member 24 is biased toward the seating member 22 by action of a spring 44. The spring 44 is retained at each end thereof by a pair of cylindrical seats: a first cylindrical seat 46 in the seating member 22 and a second cylindrical seat 48 in the biasing member 24. A handle section 50 is provided on the biasing member 24 for allowing a user to conventiently press thereupon and thereby cause the forward end 42 of the biasing member to separate from the seating member, against the biasing action of the spring 44. Integrally connected with the main body 26 of the seating member 22, is a snap-hook seat 52, which is structured to snugly receive a conventional snap-hook. The over-all construction of the snap-hook holder 14 is such that the forward end 42 of the biasing member 24 biases toward the snap-hook seat 52. As can best be seen in FIG. 4A, a tensioning screw 67 having a washer 69 is provided in the biasing member 24. By turning the tensioning screw, the biasing force of the spring 44 may be selectively increased or decreased to adjust how firmly the conventional snap-hook 54 will be seated in the snap-hook seat 52.

The depiction in FIG. 3 shows the snap-hook holder 14 in operation with a typical conventional snap-hook 54. It will be seen that the snap-hook 54 is composed of a hook 54*a* and an eyelet 54*b*, each being disposed generally along an axis, as well as in a common plane. A winch line (not shown in FIG. 3) is secured to the eyelet 54*b*, most often by a knot. The snap-hook 54 is further provided with a spring biased, pivotally mounted one-way snap 54*c* which permits an eyelet (such as a boat bow eyelet 66 in FIGS. 4A and 4B) to enter into the hook 54*a* but not escape unless the user physically pushes against the spring which biases the snap 54*c* so that the eyelet 66 can pass back out of the snap-hook 54. The combination of these structures of the snap-hook 54 result in snap-hook contour surfaces 56 on one side thereof and 56' on the other side thereof.

Referring now back to FIG. 2, the snap-hook seat 52 is structured as follows: A seat floor 52*a* for accepting the conventional snap-hook 54; on one side thereof located adjacent the U-shaped member 28, is an abutment 52*b* structured to have a seat contour surface 58 which follows that of the snap-hook contour surface 56; and at the opposite side of the seat floor 52*a*, is a nib 52*c* which is located so as to contact the hook 54*a* opposite to the abutment 52*b* in the vicinity of the snap 54*c* (shown most explicityly in FIG. 4B). The combination of the seat floor 52*a*, the abutment 52*b* and the nib 52*c* form the snap-hook seat 52 which allows the snap-hook 54 to seat snugly thereinto (as shown in FIG. 3) in the vicinity of the eyelet 54*b*.

The precise location of the seating of the snap-hook in the shap-hook seat, as shown in FIG. 3, is defined by two factors: (1) sufficient room at one end so that the eyelet 54*b* is substantially exposed, thereby allowing clearance for the winch line and its attachment knot; and (2) sufficient room at the opposite end so that the snap 54*c* has sufficient clearance to operate without interference from the nib 52*c* of the snap-hook seat. To facilitate this required clearance for optimum operational performance, a notch 60 may be provided in the biasing member 24 adjacent to the location of the eyelet 54*c*; this will ensure the winch line will not interfere with seating of the snap-hook 54 within the snap-hook seat 52.

The nib 52*c* is preferred to include a ramp 61 so as to allow the snap-hook to be slidably dislodged from the snap-hook seat by a sharp pulling movement of the handle 12, as will be detailed hereinbelow. While a single nib 52*c* has been described, it is preferred to have a second nib 52*c*' located in the snap-hook seat 52 so as to be adjacent the snap-hook eyelet 54*b*, as shown in FIG. 3. Inclusion of the second nib 52*c*' will render greater stability to the snap-hook 54 when seated in the snap-hook seat 52 as the user reaches distantly with the boat hook handle 12 trying to get the snap-hook 54 onto a boat bow eyelet, as will be described hereinbelow. Again, the nib 52*c*' is preferred to have a ramp 61' for facilitating removability of the snap-hook from the snap-hook seat when the handle 12 is sharply pulled back from the boat bow eyelet after the snap-hook 54 has been connected therewith. It is preferred that the nibs 52*c* and 52*c*' be located adjacent the forward end 62 of the seating member 22 so as to ensure little or no interference by the structure of the snap-hook holder 14 when the snap-hook 54 is being connected with an eyelet on an object, such as a boat bow eyelet 66.

It is preferred to include a boat hook member 64 on the seating member 22 at a location opposite the location of the snap-hook seat 52. The boat hook member 64 facilitates manipulations of the boat by permitting selective contact to be made with various parts of the boat, such as cleats.

Figure 5:
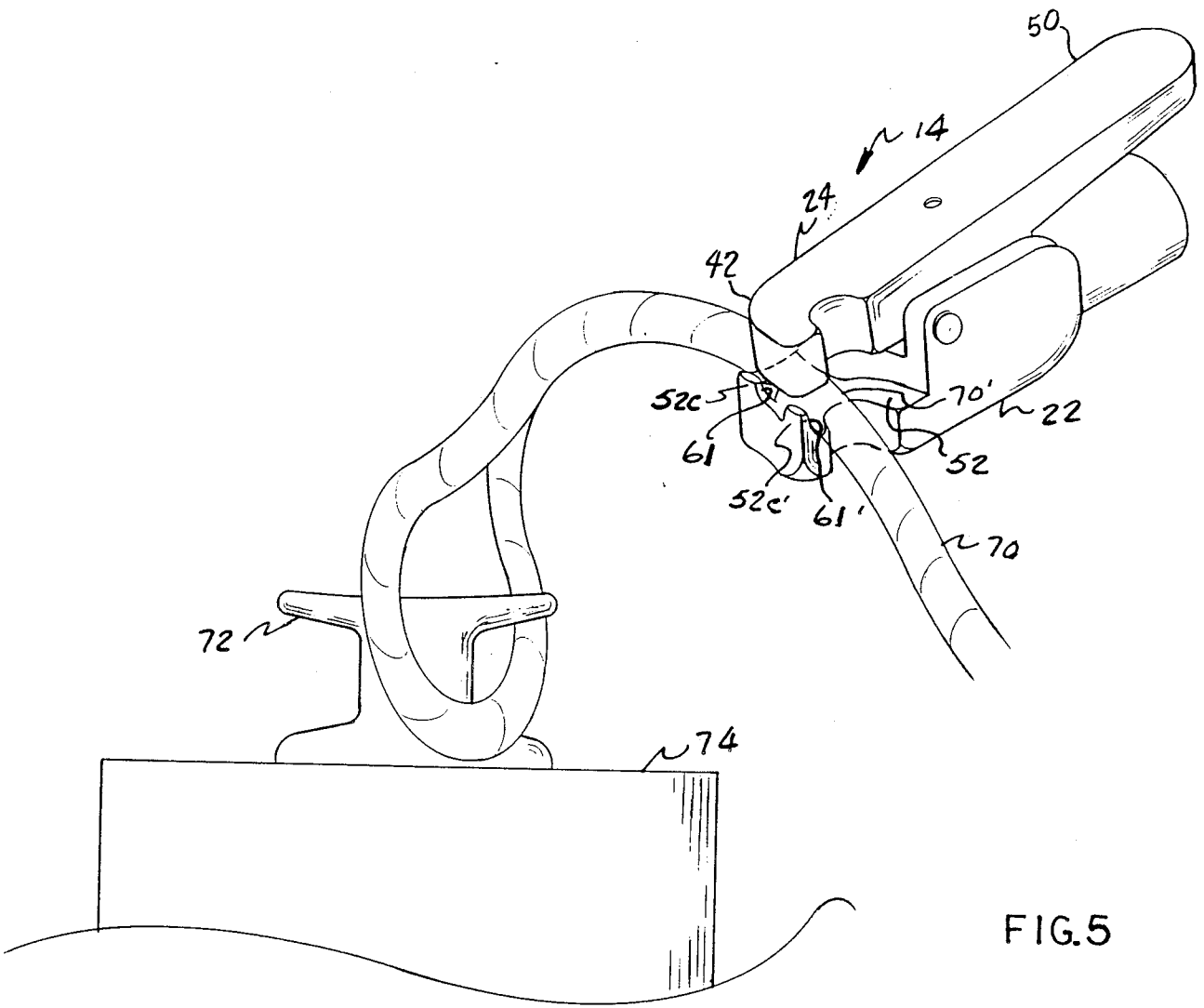
FIG. 5 is a perspective view showing the snap-hook holder of the boat hook according to the present invention in operation in which a mooring line is being secured to a dock cleat.

The boat hook 10 according to the present invention can be used to releasably hold other articles besides a conventional snap-hook. As shown in FIG. 5, one class of articles that can be held in the snap-hook seat 52 of the snap-hook holder 14 is elongate articles, such as a mooring line 70. The handle portion 50 of the biasing member 24 is pressed to allow placement of the mooring line in the snap-hook seat 52, and then the handle portion is released so that the forward end thereof 42 biases against the mooring line 70. After manipulation of the mooring line by use of the handle 12 (not shown in FIG. 5), such as to place it over a cleat 72 of a dock 74, a sharp pull on the handle 12 will release the mooring line from the snap-hook seat.

Figure 4A:
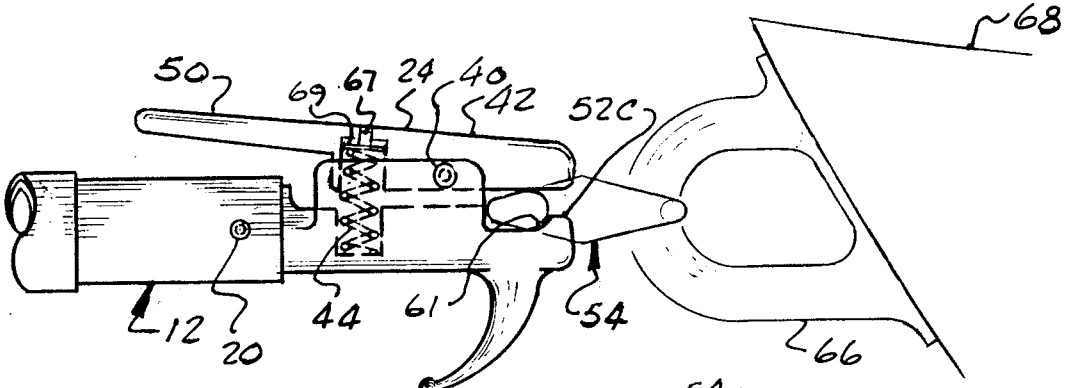
FIGS. 4A and 4B are detail views of the boat hook according to the present invention in operation with respect to a bow eyelet of a boat.
Figure 4B:
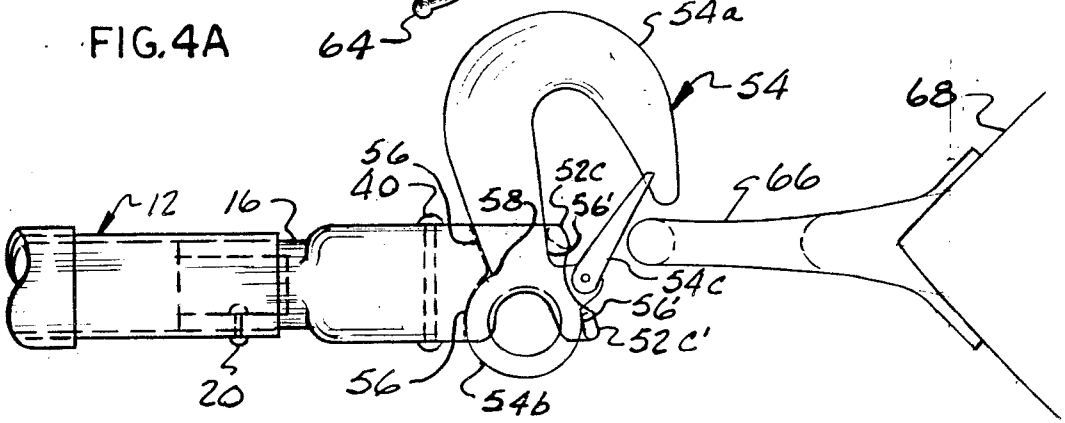

Operation of the boat hook 10 according to the present invention will now be detailed with reference being made particularly to FIGS. 4A and 4B.

A conventional snap-hook 54 is placed into the snap-hook seat 52 by pressing on the biasing member 24 at the handle section 50. The snap-hook 54 is thereupon seated into the snap-hook seat 52 with the contour 56 abutting the contour 58 and the nibs **52*c* and 52*c*' abutting the contour 56'. The biasing member is now released, and the forward end 42 thereof presses against the snap-hook, keeping it seated. With this done, the snap 54*c* faces forwardly, away from the handle 12, as shown particularly in FIG. 4B. The user then manipulates the boat hook 10 so that the hook 54*a* is brought into contact with an eyelet, such as the bow eyelet 66 of a boat 68. The user, holding the handle 12, causes the snap-hook 54 to be pushed-up against the bow eyelet 66, thereby causing the snap 54*c* to be retracted and the hook 54*a* to enter into the bow eyelet 66 until the snap biases back, thereby trapping the hook 54*a*** on the bow eyelet.

Now, the user may adjust the position of the boat as it floats on the water using the boat hook 10 because the snap-hook is seated sufficiently in the snap-hook seat 52 to allow for these forces without dislodging the snap-hook 54 from the snap-hook seat 52.

When the user decides to release the snap-hook from the boat hook 10, all that needs to be done is to give a sharp tug away from the bow eyelet 66. This impulse causes the snap-hook to travel up the ramps 61 and 61', thereby freeing the snap-hook from the snap-hook seat. The winch line now has full control over movement of the boat, and the boat is now ready to be winched onto the boat trailer, the user never risking getting wet in the process.

To those skilled in the art to which this invention appertains, the above described preferred embodiment may be subject to change or modification. For instance, the snap-hook seat 52 may be oriented in the snap-hook holder 14 differently from that shown in the Drawings. That is, it is within the contemplation of the present invention for the snap-hook seat to be oriented in the snap-hook holder so as to allow not only a perpendicular orientation for the standard snap-hook 54, as shown in the Drawings, but also at another angle other than perpendicular so as to facilitate the connection of the snap-hook 54 to a secondary object, such as the boat bow eyelet 66. Such change or modification can be carried out without departing from the scope of the invention, which is intended to be limited only by the scope of the appended claims.

What is claimed is:

1. A holder for a conventional snap-hook, the conventional snap-hook having generally axially aligned hook and eyelet components arranged generally on a common plane, the conventional snap-hook further having a spring biased snap component, said holder comprising:

a biasing member, said biasing member having a forward end and an opposite handle end;

a seating member having a first end and a second end;

an elongate handle connected with said second end of said seating member;

pivoting means for pivotally attaching said biasing member to said seating member;

biasing means for biasing said forward end of said biasing member toward said seating member, movement of said handle end of said biasing member permitting said forward end of said biasing member to be pivoted away from said seating member; and a snap-hook seat integral with said first end of said seating member, said snap-hook seat being structured to snugly receive a pre-selected portion of the conventional snap-hook, said snap-hook seat being further structured so as not to interfere with operation of the hook, eyelet and spring biased snap components of the conventional snap-hook when the conventional snap-hook is seated in said snap-hook holder; said forward end of said biasing member applying a biasing force toward said snap-hook seat for selectively retaining the conventional snap-hook in said snap-hook seat, said handle end of said biasing member permitting said forward end of said biasing member to be pivoted away from said snap-hook seat sufficiently to allow seating of the conventional snap-hook into said snap-hook seat;

wherein the conventional snap-hook may be selectively connected to an object and the conventional snap hook may then be removed from said snap-hook seat by pulling said second end of said seating member away from the object.

2. The holder of claim 1, wherein said snap-hook seat and said biasing means are structured to enable a pre-selected article to be biasably seated in said snap-hook seat; further wherein said pre-selected article may be thereafter connected to a selected object and said pre-selected article may thereupon be removed from said snap-hook seat by pulling said second end of said seating member away from the selected object.

3. The holder of claim 2, wherein said pre-selected article is selected from a class of elongate articles, said class of elongate articles including a mooring line.

4. The holder of claim 3, wherein said snap-hook seat comprises:

a seat floor;

an abutment located at a first side of said seat floor, said abutment being contoured to substantially match a first contour of the pre-selected portion of the conventional snap-hook; and a first nib located at a second side of said seat floor opposite said first side thereof, said first nib abutting contour of the hook component of the conventional snap-hook when the conventional snap-hook is seated in said snap-hook seat such that the conventional snap-hook is simultaneously abutting both said seat floor and said abutment.

5. The holder of claim 4, wherein said first nib is ramped where said first nib abuts the conventional snap-hook.

6. The holder of claim 2, further comprising a second nib located at said second side of said seat floor in a spaced relation from said first nib, said second nib abutting the second contour of the hook component of the conventional snap-hook when the conventional snap-hook is seated in said snap-hook seat such that the conventional snap-hook is simultaneously abutting both said seat floor and said abutment.

7. The holder of claim 6, wherein said second nib is ramped where said second nib abuts the conventional snap-hook.

8. The holder of claim 7, further comprising hook member means connected with said seating member for selectively manipulating objects with said holder.

9. The holder of claim 8, wherein said elongate handle is composed of a plurality of segments, further wherein said plurality of segments are telescopically interconnected with each other so that said handle may be selectively varied in length.

10. The holder of claim 9, further comprising biasing means adjustment means for selectively adjusting said biasing force.

* * * * *